United States Patent [19]

Grisé et al.

[11] 3,972,512

[45] Aug. 3, 1976

[54] MIXING MATERIALS IN CONTAINERS

[76] Inventors: Frederick G. J. Grisé, 130 Hesperus Ave., Magnolia, Mass. 01932; Walter Lovell, 348 Mountain Road, Wilbraham, Mass. 01095

[22] Filed: Dec. 19, 1974

[21] Appl. No.: 534,623

Related U.S. Application Data

[62] Division of Ser. No. 399,862, Sept. 24, 1973, Pat. No. 3,862,748.

[52] U.S. Cl. ..... 259/102; 259/118

[51] Int. Cl.[2] ..... B01F 7/30

[58] Field of Search ..... 250/102, 107, 108, 116, 250/117, 118, 119, 121, 122, 123, 124, 103, 106, 66, 67, DIG. 16, DIG. 30, DIG. 38; 222/83; 141/329, 330; 259/21–24, 115

[56] References Cited

UNITED STATES PATENTS

| | | | |
|---|---|---|---|
| 2,025,379 | 12/1935 | Croasdale | 259/DIG. 38 |
| 3,321,188 | 5/1967 | Unger | 259/118 |
| 3,796,512 | 3/1974 | Djuvik | 259/DIG. 29 |

FOREIGN PATENTS OR APPLICATIONS

| | | | |
|---|---|---|---|
| 594,923 | 11/1947 | United Kingdom | 259/116 |

*Primary Examiner*—Robert W. Jenkins
*Attorney, Agent, or Firm*—Charles R. Fay

[57] ABSTRACT

A container for materials to be mixed e.g., paint, said container having a removable plug in an aperture, said plug being removable for adding materials to the mixture, the plug having a diaphragm to be pierced by a single sharp mixing member and including means to rotate the mixing member while the container is completely closed. The mixing member is a needle or the like having its major portion at an angle to the axis of the means rotating it.

2 Claims, 9 Drawing Figures

MIXING MATERIALS IN CONTAINERS

This is a division of Ser. No. 399,862, filed Sept. 24, 1973, now U.S. Pat. No. 3,862,748.

BACKGROUND OF THE INVENTION

Many materials such as paint not only have to be mixed in order to obtain a wanted hue, but also the materials of the paint tend to separate in storage and they have to be mixed (homogenized) before using even though no coloring material should be added.

There are many power-operated paint stirrers all of which must be used with the paint can cover removed and of course this results in splashing and many times in poor mixing efficiency so that the stirrer has to be used for a relatively long period of time and moved around inside the container to make sure that the entire content is thoroughly mixed.

Another way of accomplishing the mixing is to shake the can while closed and there are apparatuses on the market for this purpose. However it is difficult and time consuming to add pigmentation, etc. to the already packaged paint because the cover must be removed and replaced after adding the paint in order to take advantage of the shaking action of the shaking apparatus, which sometimes takes as much as an hour or more to actually mix the paint. Shaking and stirring are very different procedures and in most cases the shaking takes a relatively long period of time to accomplish.

It is the object of this invention to provide an in-place stirrer which operates on the material to be mixed when the container is completely closed. It has been found that through the use of this invention materials e.g., paint, can be mixed in a few seconds.

SUMMARY OF THE INVENTION

A conventional container having the usual removable cover or lid is provided with an opening closed by a plug so that when the container has been filled it may be shipped in the usual manner without spilling or loss of any of the material therein.

The plug has a pierceable membrane or diaphragm which is easily pierced by a single sharp stirring element, preferably in the form of a needle or the like, which may be operated as for instance by an electric motor, said needle having the distal sharp portion thereof inclined with respect to the axis or other portion which is chucked to and driven by the electric motor.

This stirring needle is preferably made of plastic and it is so light that there is no appreciable centrifugal force involved, but when driven at a relatively high rate of speed it provides a kind of pumping action, forcing the material in the container down around and up to the vortex provided by the junction of the distal sharp portion of the stirrer with the driven portion thereof, and with the use of this device paint or other materials may be completely mixed in a few seconds. The plug is removable to add pigments to the paint to obtain different hues. The membrane is flexible, seals the stirrer and cleans it when it is withdrawn.

In some cases a stationary sleeve is provided about the needle to form a sealing fit between the needle and the material of the membrane adjacent the pierced area thereof, the stationary sleeve providing against any damage which might occur to the membrane under conditions of high speed of rotation of the stirring needle.

It will be seen that this device is self-cleaning and no splash or other mess can possibly result from the high speed mixing action because of the fact that the container is completely closed when this action takes place and it is not necessary to even wipe off the stirrer prior to using it in another container containing a different kind of material.

The stirring element may be used in conjunction with for instance a small electric motor, used for drilling, or commercial installations may be provided in a permanent location so that the paint to be mixed is merely positioned under the same and the motor and stirrer brought down to pierce the membrane and to stir the paint, and in such case a timer could be used also, together with a balancing weight for the device, normally keeping it in up, inoperative, position.

PREFERRED EMBODIMENT OF THE INVENTION

Figure 1:
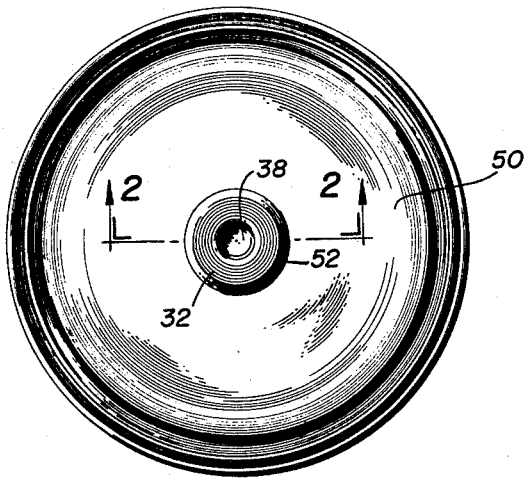
FIG. 1 is a top plan view of a container cover having the plug mounted therein.
Figure 2:
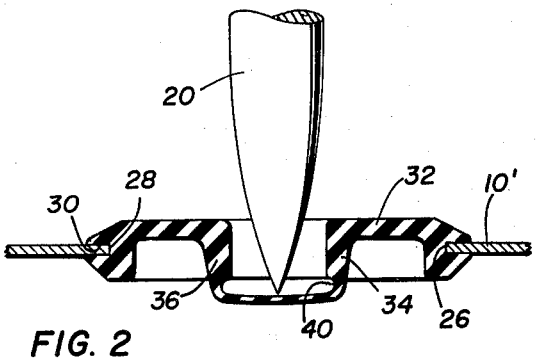
FIG. 2 is a view in section on line 2—2 of FIG. 1.
Figure 3:
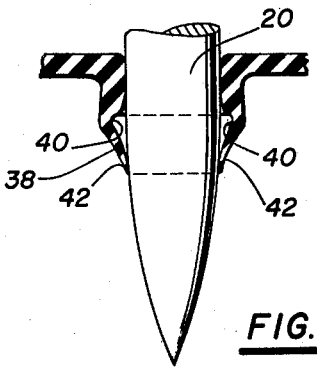
FIG. 3 is a similar view illustrating the action of piercing the plug by means of the stirring needle.

A container 10 which may be a conventional paint can of any size has the usual separable cover or lid 12 as is well known. The cover is provided with a central opening having an elastomeric plug 14 therein, this plug having a pierceable diaphragm indicated by the reference numeral 16 which is to be pierced by a needle 18. Needle 18 has an inclined sharpened distal tip portion 20 and may be chucked in a drill motor 22 so as to be driven thereby at its proximate end.

Figure 5:
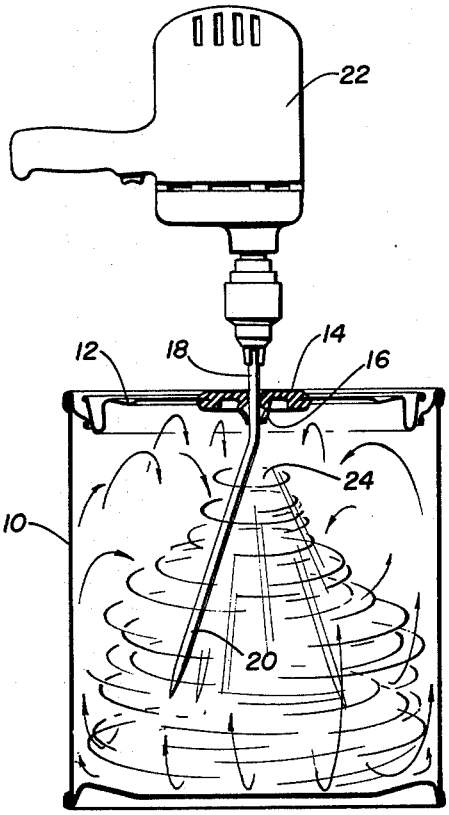
FIG. 5 is a diagrammatical view illustrating the action of the invention.
Figure 4:
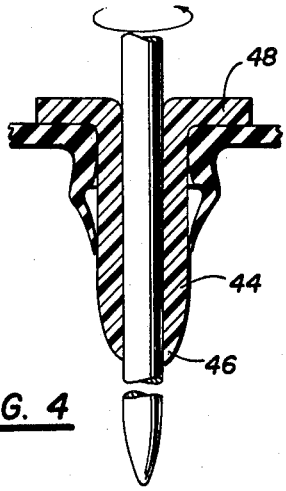
FIG. 4 is a similar view illustrating a sleeve bearing for the needle.
Figure 6:
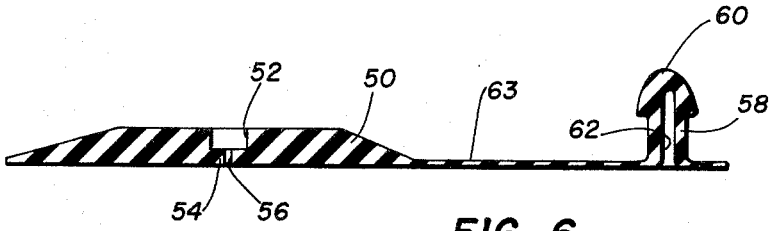
FIG. 6 is a sectional view illustrating a modified plug.
Figure 7:
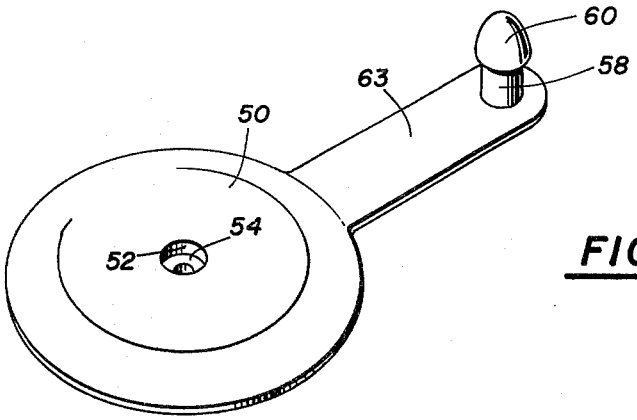
FIG. 7 is a perspective view thereof.
Figure 8:
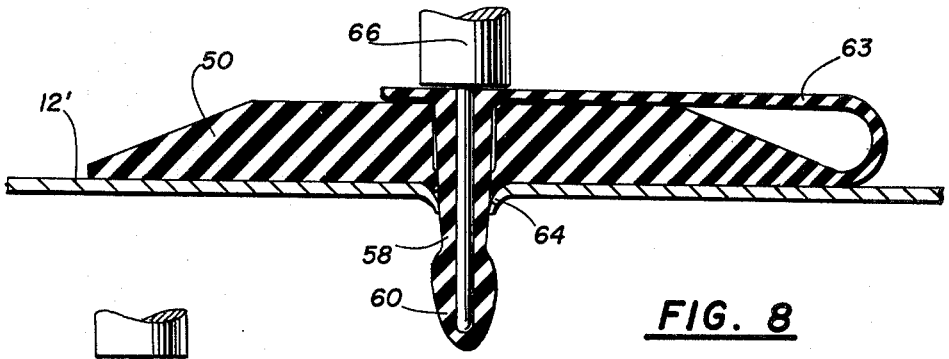
FIG. 8 is a section illustrating the action of the plug of FIGS. 6 and 7.
Figure 9:
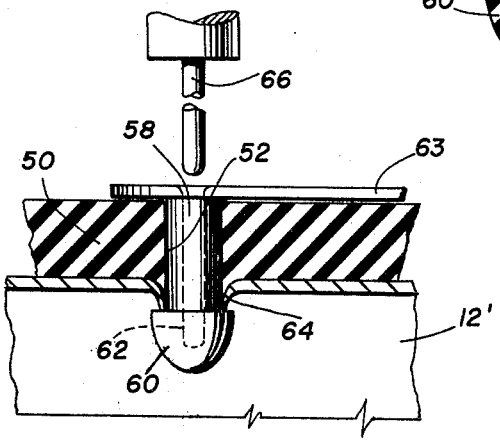
FIG. 9 is a similar view showing the action of the play upon retraction of the needle.

It is to be understood that the plug is impervious but may be pierced by the needle as is clearly shown in FIG. 5 whereupon the electric drill motor 22 being energized, the portion 20 of the needle will move on a conical surface of revolution.

It is to be emphasized that this action is at a relatively high rate of speed and it has been found that in the closed container illustrated, a pumping action occurs drawing the material throughout the entire container starting from the top of the container down and around into the conical configuration of the action of the portion 20 of the needle, the material then moving upward to the vortex thereof which is indicated at 24, this action being almost instantaneous and continuously repeated.

By this action all of the material is thoroughly mixed in a few seconds. It is also emphasized that this action is completely different from any kind of rotary paddle as sometimes used in open containers, and it is also very different from the shaking action occasioned by shaking apparatuses referred to above.

The lid 12 has an opening therein having its edges defined at 26 and 28 and a rubber-like plug is provided with an annular groove 30 for snapping into and completely closing the opening.

The plug preferably has a relatively self-sustaining annular portion at 32 extending from the grooved portions 30 and centrally of the plug extending downwardly of the plug as is clearly shown at 34, 36 in a generally cylindrical formation having a closed thin pierceable membrane or diaphragm 38 at the bottom defined by an annular indented groove 40.

In the use of the device the plug may first be removed completely for adding pigments if this should be desired and then the plug is snapped back into the opening and being of a rubbery nature although self-sustaining at least in the areas 32, it will be seen to completely reclose the container. Then the sharpened distal portion 20 of the needle is thrust into the cylindrical member 34, 36 and pierces the diapragm 38 whereupon the annular portions of the membrane extend downwardly into close sealing and lightly gripping association with respect to the sharp portion 20 of the needle.

When the needle is retracted, the diaphragm portions 34 wipe it, cleaning the needle of all material into which it has been thrust for the stirring action.

In some cases the sealing and gripping action may be found to be a little too tight, in which case the diaphragm might be damaged, and a stationary sleeve of any suitable material, for instance Teflon, may be inserted in the plug when the diaphragm has been pierced in order to form a bearing and protection for the diaphragm against the high speed action of the needle portion 20. The sleeve is generally indicated at 44 and it is preferably generally cylindrical with a thinned-down forward edge 46 to make it easier to penetrate between the diaphragm and the needle, and it is also preferably provided with a flange 48 to locate the sleeve and prevent it from falling into the material which is to be mixed.

We claim:

1. The method of mixing material in a closed container comprising advancing a generally straight single element needle having a sharpened end portion at an incline relative thereto piercing through a re-piercable and reclosing elastomeric diaphragm on a wall of the container, and then by rotating the needle, forming a pumping action on the material throughout the container between top and bottom of the container while it is completely closed.

2. The method of claim 1 including wiping the needle by the diaphragm upon withdrawal of the needle from the container.

* * * * *